US009386836B2

(12) United States Patent
Lee

(10) Patent No.: US 9,386,836 B2
(45) Date of Patent: Jul. 12, 2016

(54) COSMETIC CASE HAVING SEALING FUNCTION

(71) Applicants: CTK CO., LTD., Seoul (KR); Chung-Gil Lee

(72) Inventor: Chung-Bae Lee, Hwasung-si (KR)

(73) Assignee: Chung-Gil Lee, Gyeonggi-Do (KR)

( * ) Notice: Subject to any disclaimer, the term of this patent is extended or adjusted under 35 U.S.C. 154(b) by 408 days.

(21) Appl. No.: 14/095,009

(22) Filed: Dec. 3, 2013

(65) Prior Publication Data

US 2014/0231304 A1 Aug. 21, 2014

(30) Foreign Application Priority Data

Feb. 20, 2013 (KR) ..... 10-2013-0018002

(51) Int. Cl.
*A45D 33/00* (2006.01)

(52) U.S. Cl.
CPC ..... *A45D 33/006* (2013.01); *A45D 33/003* (2013.01); *A45D 33/008* (2013.01)

(58) Field of Classification Search
CPC . A45D 33/006; A45D 33/008; A45D 33/003; A45D 33/24; A45D 33/34; A45C 5/005; A45C 11/008; B65D 51/18
USPC ..... 206/581, 235, 823, 38, 229; 132/293, 132/295
See application file for complete search history.

(56) References Cited

U.S. PATENT DOCUMENTS 6,336,460 B2 * 1/2002 Yuhara ..... 132/295
7,464,820 B2 * 12/2008 Oh ..... A45D 33/008 132/293
7,726,322 B2 * 6/2010 Cho ..... A45D 33/04 132/294
8,006,706 B2 * 8/2011 Sekine ..... A45D 40/221 132/293
2002/0014434 A1 * 2/2002 Mathiez ..... A45C 13/008 206/581
2004/0069677 A1 * 4/2004 Baudin ..... B65D 51/18 206/581
2004/0139980 A1 * 7/2004 Habatjou ..... A45D 33/006 132/300
2007/0029226 A1 * 2/2007 Yuhara ..... A45D 33/006 206/581
2015/0320174 A1 * 11/2015 Kim ..... A45D 33/006 132/295

FOREIGN PATENT DOCUMENTS

KR 20-0367726 11/2004

* cited by examiner

*Primary Examiner* — Steven A. Reynolds
(74) *Attorney, Agent, or Firm* — IPLA P.A.; James E. Bame

(57) ABSTRACT

Provided is a cosmetic case having a sealing function which prevents a gap from being formed between a main body and a cover, thus preventing cosmetics from being contaminated during a process of distribution. In the cosmetic case, a suction member can be reliably attached to the main body by suction force so that a gap is prevented from being formed therebetween. Therefore, cosmetics contained in the main body can be prevented from being contaminated during a process of distribution, and the weight of cosmetics can be maintained. Furthermore, when the user presses a button member, a cover opens and, simultaneously, the suction force of the suction member is removed, thus allowing the user to easily open the cover and suction cover unit.

9 Claims, 12 Drawing Sheets

COSMETIC CASE HAVING SEALING FUNCTION

CROSS REFERENCE

This application claims foreign priority under Paris Convention and 35 U.S.C. §119 to Korean Patent Application No. 10-2013-0018002, filed Feb. 20, 2013 with the Korean Intellectual Property Office.

BACKGROUND OF THE INVENTION

1. Field of the Invention

The present invention relates generally to cosmetic cases having sealing functions and, more particularly, to a cosmetic case having a sealing function which prevents a gap from being formed between a main body and a cover, thus preventing cosmetics from being contaminated during a process of distribution.

2. Description of the Related Art

Generally, cosmetics are care substances used to protect the skin and enhance the appearance. Most adult women wear make-up daily. To apply make-up, cosmetics such as powder, foundation, etc. and cosmetic tools such as brush are used. Typically, such cosmetics are contained and stored in separate cosmetic cases, as proposed in Korean Utility Model Registration No. 20-0367726.

FIG. 1 illustrates a conventional cosmetic case. Referring to FIG. 1, the conventional cosmetic case includes a main body which contains cosmetic powder P, cream or the like therein, and a cover 20 which closes an opening of the main body. A protective cover 30 is seated at the perimeter thereof on an upper end of the main body. A plurality of powder discharge holes 32 are formed in a central portion of the protective cover 30. The protective cover 30 functions to discharge only an appropriate amount of powder while preventing the powder from spilling out. Receiving a puff 40, a stepped receiving space 12 is formed in an upper surface of the protective cover 30. An external thread 12 is formed on an outer circumferential surface of the main body. An internal thread 22 is formed on an inner circumferential surface of the cover 20. The cover 20 is threaded over the main body.

Meanwhile, to prevent cosmetic powder or the like from being contaminated by bacteria, etc. during a process of distribution, the space between the main body and the cover 20 is vacuum sealed. Although cosmetic cases are produced from factories in a vacuum-sealed state, in the case of some of cosmetic cases, a gap occurs between the main body and the cover 20, for example, because of impact applied thereto during a process of distribution. In this case, air reaches cosmetic powder through the gap, whereby the cosmetic powder may be contaminated by different kinds of bacteria such as staphylococcus, colon bacillus, etc. during a process of distribution. In addition, the cosmetic powder may be oxidized. As such, there is a problem in that cosmetics are contaminated even before opening. Moreover, air comes in and out of the cosmetic case through the gap formed between the main body and the cover 20, and some of the cosmetic powder contained in the main body may leak out of the case, whereby the weight of the cosmetic is reduced.

SUMMARY OF THE INVENTION

Accordingly, the present invention has been made keeping in mind the above problems occurring in the prior art, and an object of the present invention is to provide a cosmetic case which can prevent a gap from being formed between a main body and a cover, thus preventing cosmetics from being contaminated during a process of distribution, and maintaining the weight of cosmetics contained in the case.

In order to accomplish the above object, the present invention provides a cosmetic case having a sealing function, including: a main body defining a receiving space therein and having an opening formed above the receiving space, with a support surface provided on an inner circumferential surface of the receiving space, the support surface being oriented facing the opening; a suction cover unit inserted into the receiving space, the suction cover unit comprising a suction member closing the opening in such a way that a perimeter of an inner surface of the suction member is attached to an upper surface of the support surface by suction force; and a suction force removal unit having a button member having a first side portion disposed to be exposed to an outside from an outer surface of a circumferential side surface of the main body, and a second side portion disposed in a space defined inside the circumferential side surface of the main body, and a suction force removal member disposed inside the circumferential side surface of the main body at a position facing the second side portion of the button member, the suction force removal member being moved upwards by a pushing force of the button member so that an upper end of the suction force removal member passes through the support surface and moves the suction member upwards.

Furthermore, the second side portion of the button member may be disposed below the support surface and comprises an inclined part provided around an inner surface of the circumferential side surface of the main body. The inclined part may have an inclined pressing surface inclined downwardly towards a central portion of the main body. The suction force removal member may include: a guide protrusion having an upper end passing through the support surface; and a movement guide protruding from the guide protrusion towards the inclined pressing surface. When the inclined pressing surface is moved towards the central portion of the main body by the pushing force of the button member, the movement guide that comes into contact with the inclined pressing surface may move upwards along the inclined pressing surface, whereby the upper end of the guide protrusion may push the suction member upwards.

The cosmetic case may include a cover covering the opening. An insert hole may be formed in the second side portion of the button member, the insert hole being open towards an upper portion of the main body, and a locking hook is provided in the insert hole and oriented towards the inner surface of the circumferential side surface of the main body. A first side portion of the cover may be rotatably coupled to a portion of the main body, and a locking protrusion may be provided on a second side portion of the cover. The locking protrusion may be inserted into the insert hole through the upper portion of the main body and locked to the locking hook. When the locking hook is moved by the pushing force of the button member, the locking protrusion may be released from the locking hook.

The main body may have a double structure including a first main body and a second main body disposed in the first main body. The suction force removal unit may be provided in space formed between a circumferential side surface of the first main body and a circumferential side surface of the second main body, and a guide unit may be provided on an inner surface of the circumferential side surface of the first main body or an outer surface of the circumferential side surface of the second main body, the guide unit guiding movement of the button member or the suction force removal member.

An elastic protrusion may be provided on the second side portion of the button member, the elastic protrusion extending along the inner surface of the circumferential side surface of the first main body, wherein when the button member is pushed towards the second main body, the button member may be elastically biased by elastic force of the elastic protrusion in a reverse direction.

The suction cover unit may further include a puff receiving member provided on an upper surface of the suction member.

A side portion of the suction cover unit may be rotatably coupled to the main body.

The suction member may be made of soft material having elasticity and capable of providing suction force and be configured such that a lower surface thereof is gradually curved upwards from a perimeter thereof to a central portion.

The cosmetic case may further include a tray provided in the receiving space of the main body to receive contents therein, the tray being configured such that an upper end thereof is disposed below the support surface.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a cosmetic case having a sealing function according to a preferred embodiment of the present invention will be described in detail with reference to the attached drawings.

Figure 1:
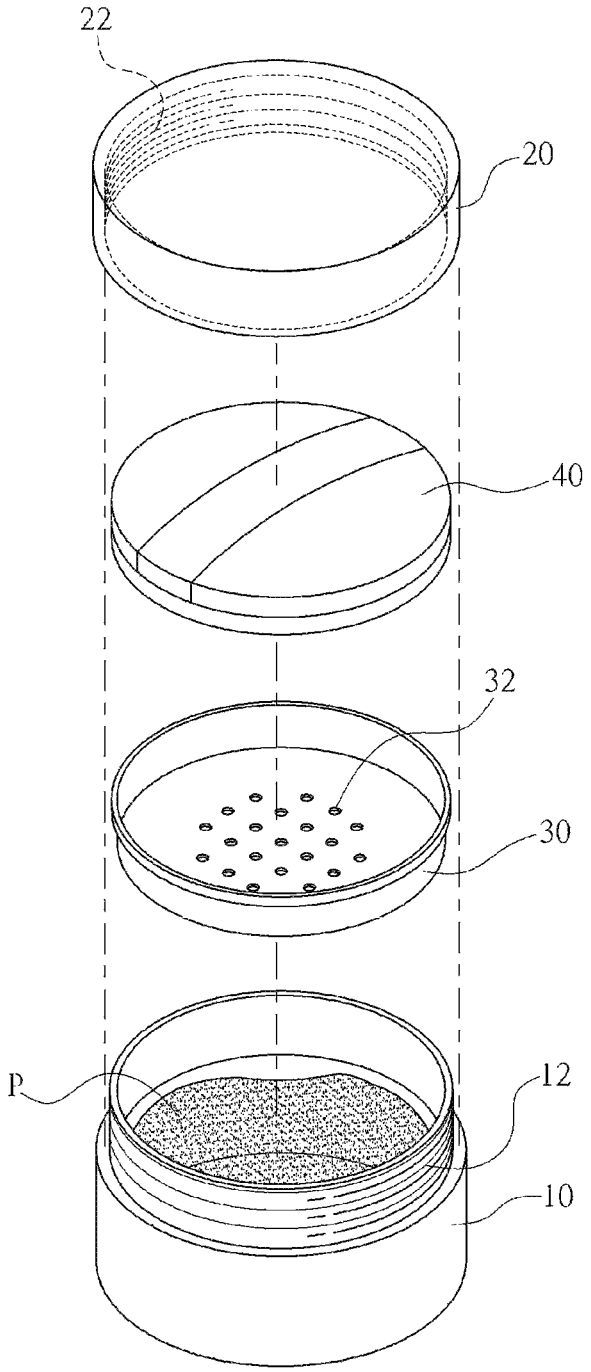
FIG. 1 Prior Art
FIG. 1 is a view illustrating a conventional cosmetic case.
Figure 2:
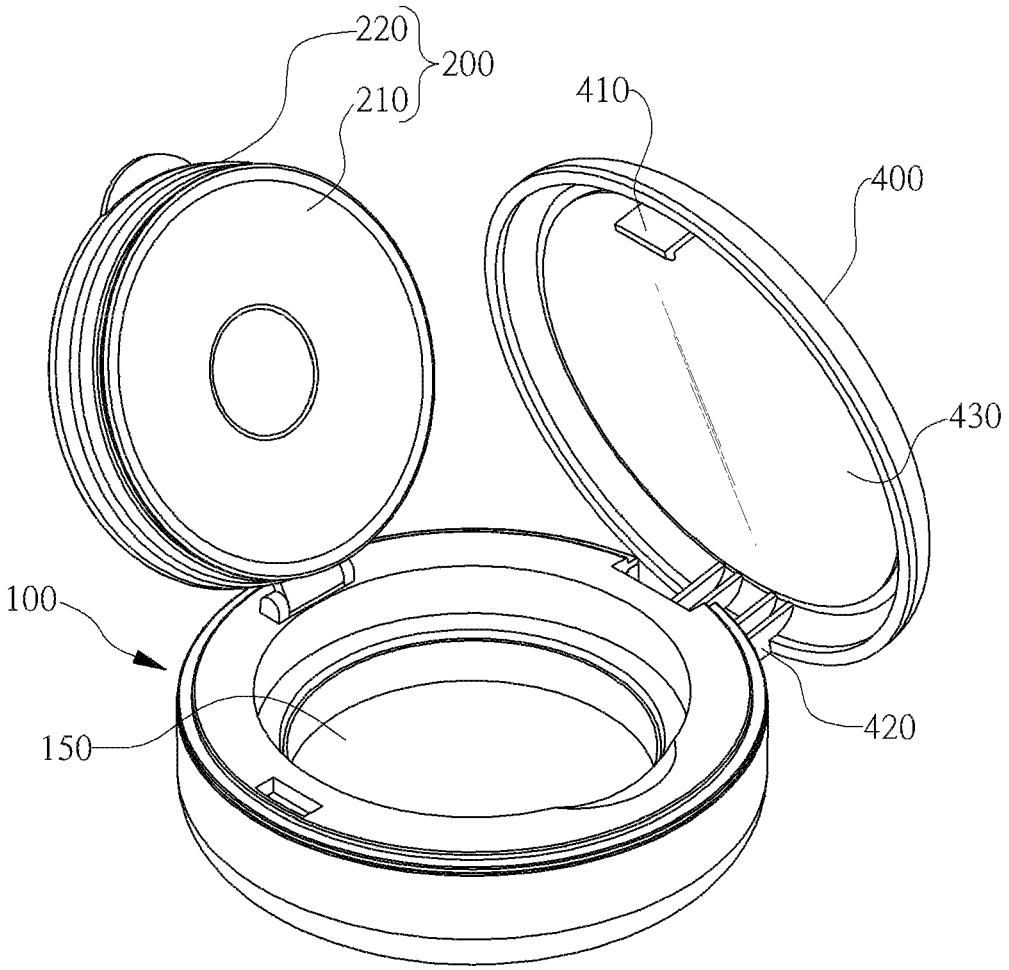
FIG. 2 is a view illustrating a cosmetic case having a sealing function, according to an embodiment of the present invention.
Figure 3:
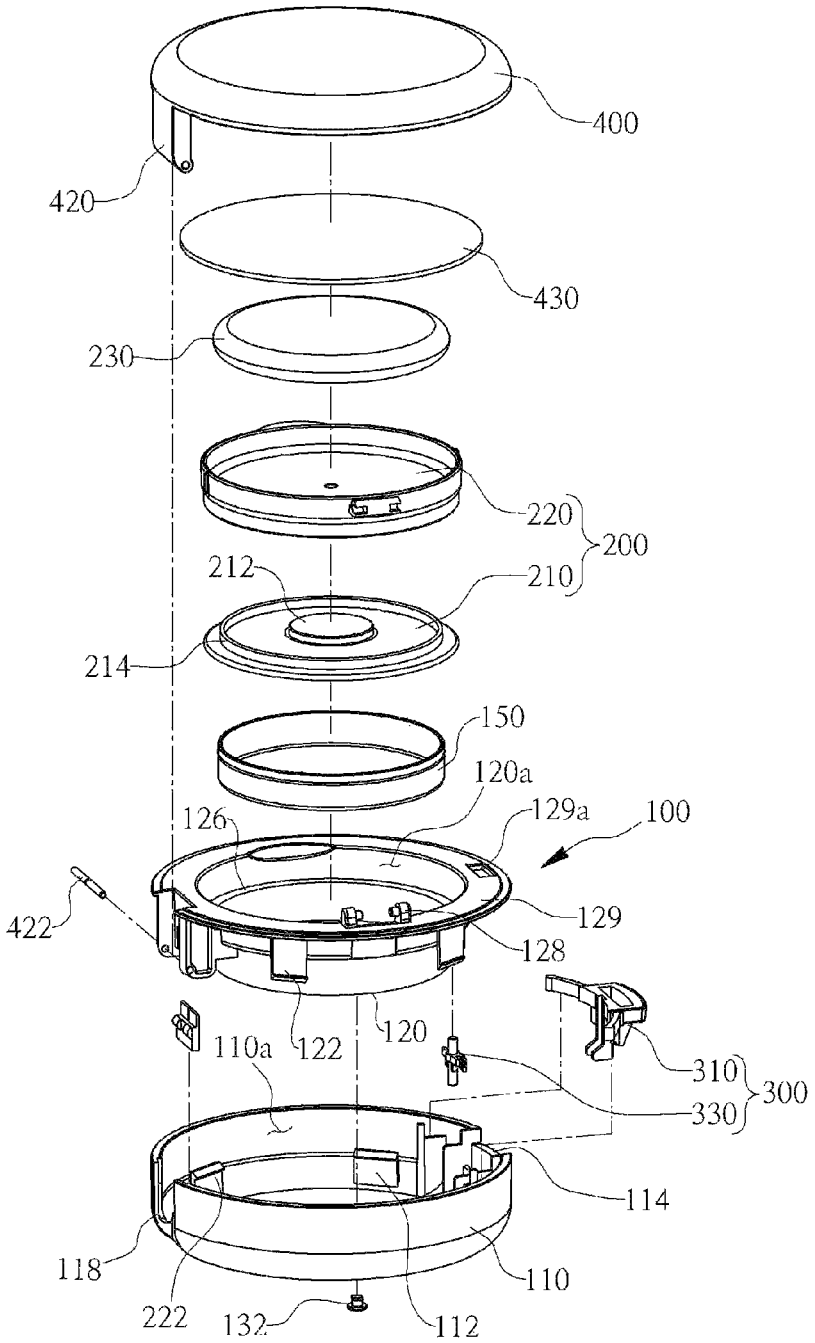
FIGS. 3 and 4 are exploded perspective views of the cosmetic case according to the embodiment of the present invention.
Figure 4:
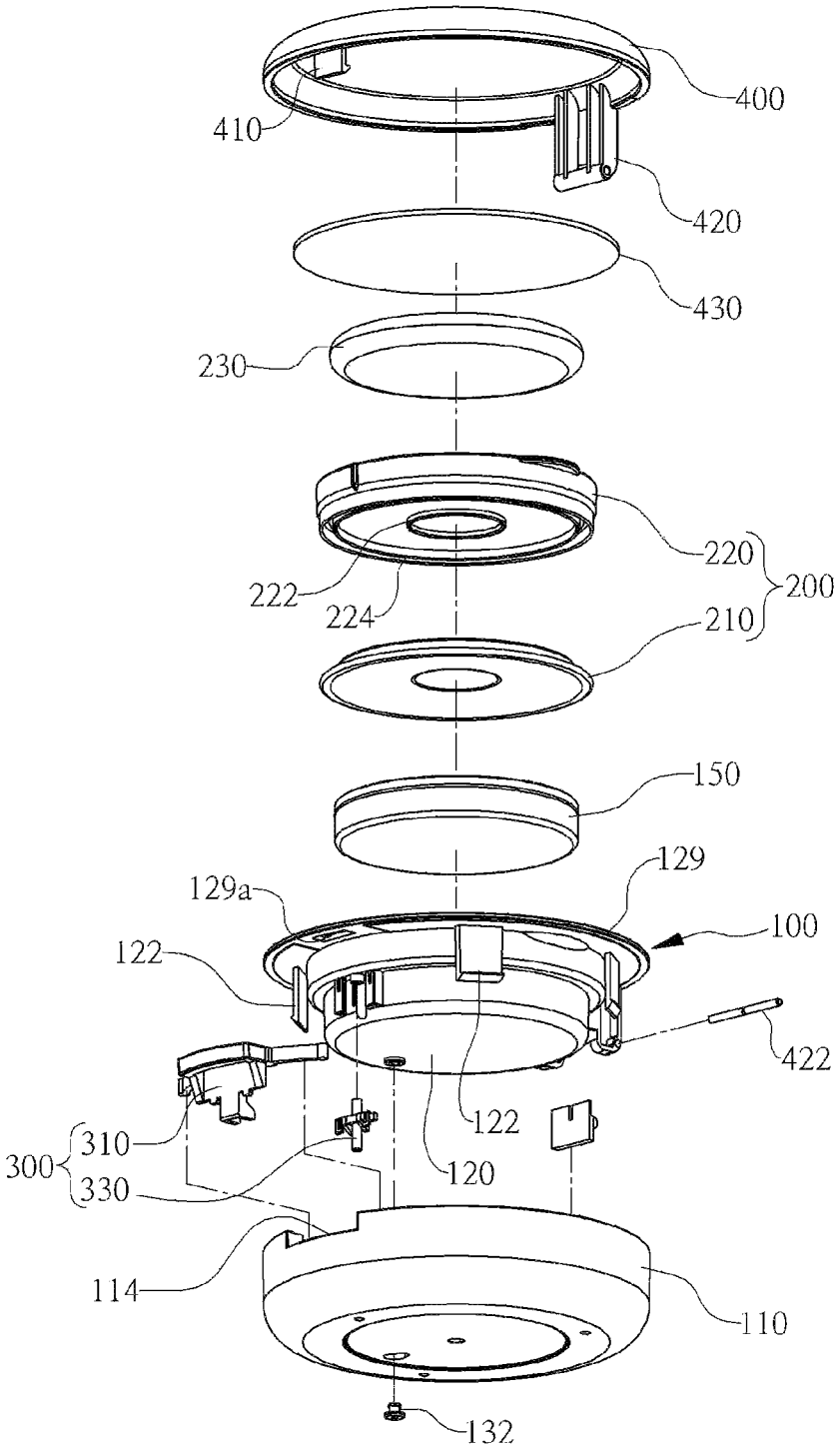

FIG. 2 is a view showing the cosmetic case according to the embodiment of the present invention. FIGS. 3 and 4 are exploded perspective views of the cosmetic case according to the embodiment of the present invention.

Referring to FIGS. 2 through 4, the cosmetic case according to the embodiment of the present invention includes a main body 100, a suction cover unit 200, a suction force removal unit 300 and a cover 400.

The main body 100 contains contents such as cosmetics therein and has a double structure that includes a first main body 110 and a second main body 120 which is received in the first main body 110.

The first main body 110 has therein a space for receiving the second main body 120. A first opening 110*a* is formed in an upper end of the first main body 110.

The second main body 120 is seated into the first main body 110 through the first opening 110*a* and has a space for receiving contents therein. A second opening 120*a* is formed in an upper end of the second main body 120. The contents include a tray 150, the cosmetics that are received in the tray 150, the suction cover unit 200, a puff 230, etc. The cosmetics may comprise cosmetic powder, foundation or cream. A circumferential side surface of the second main body 120 includes a lower cylindrical side surface 121*a*, an upper cylindrical side surface 121*b* which has a lager inner diameter than that of the lower cylindrical side surface 121*a* and is disposed above the lower cylindrical side surface 121*a*, and a support surface 126 which connects an edge of the lower cylindrical side surface 121*a* to an edge of the upper cylindrical side surface 121*b*. Here, the support surface 126 is oriented such that an upper surface thereof faces the second opening 120*a*.

When the second main body 120 is received in the first main body 110, an outer circumferential surface of the second main body 120 is spaced apart from an inner circumferential surface of the first main body 110, thus forming a side space 130 (refer to FIG. 11) therebetween. A rim part 129 is provided on an upper edge of the second main body 120. The rim part 129 extends towards the upper end of the first main body 110 a predetermined width corresponding to the width of the side space 130, that is, the distance between the side surface of the first main body 110 and the side surface of the second main body 120.

To reliably couple the first main body 110 and the second main body 120 to each other, a first coupling part 112 is provided on the inner circumferential surface of the first main body 110, and a second coupling part 122 is provided on the outer circumferential surface of the second main body 120 so that the first and second coupling parts 112 and 122 are coupled to each other. As such, because the second coupling part 122 is locked to the first coupling part 112, the second main body 120 is reliably fastened to the first main body 110. Each of the first and second coupling parts 112 and 122 may be a single coupling part or, alternatively, a plurality of coupling parts spaced apart from each other at regular intervals. Moreover, a fastening bolt 132 may be tightened into both the bottom of the first main body 110 and the bottom of the second main body 120 so that the first main body 110 and the second main body 120 can be more reliably coupled to each other.

The suction cover unit 200 includes a suction member 210 which is circular and is attached at the perimeter thereof to the upper surface of the support surface 126 using suction force to close the second main body 120, and a puff receiving member 220 which is provided on an upper surface of the suction member 210. The suction member 210 uses a vacuum suction force to be attached to the upper surface of the support surface 126. When the suction force removal unit 300 which will be explained in detail later herein is operated, the suction member 210 can be easily detached from the upper surface of the support surface 126. The suction cover unit 200 will be explained in detail later herein with reference to FIG. 5.

The suction force removal unit 300 includes a button member 310 and a suction force removal member 330. The button member 310 is provided such that a first side thereof is exposed to the outside from the circumferential surface of the first main body 110, and a second side thereof is disposed in the side space 130 between the first main body 110 and the second main body 120. The suction force removal member 330 functions to easily remove suction force that has been applied to the suction member 210. Once the suction member 210 is attached to the support surface 126 by means of suction force, it is not easily detached, even when required, therefrom because of vacuum pressure. In order to avoid this disadvantage, the present invention uses the suction force removal member 330 for easily removing suction force of the suction member 210. The suction force removal member 330 is disposed in the side space 130 in such a way that a lower end thereof is brought into contact with the second side of the button member 310, and an upper end thereof is located adjacent to the lower surface of the suction member 210 after passing through the support surface 126. The suction force removal member 330 is moved upwards by the pushing force of the button member 310, thus pushing the lower surface of the suction member 210 upwards, whereby the lower surface of the suction member 210 can be detached from the upper surface of the support surface 126. This operation will be explained in detail later herein with reference to the following attached drawings.

The cover 400 is coupled to the first main body 110 by a hinge and functions to cover the first opening 110*a* of the first main body 110. For this, a rotational coupling part 420 is formed on a first side of the cover 400, and a rotation guide part 118 is formed in a portion of the circumferential side surface of the first main body 110 to guide the rotational coupling part 420. The rotational coupling part 420 is guided by the rotation guide part 118 and is coupled to the first main body 110 by a hinge pin 422. Thereby, the cover 400 is provided so as to be rotatable with respect to the first main body 110. A mirror 430 is attached to an inner surface of the cover 400 so that the user can easily observe his/her face, etc. when applying make-up.

Figure 5:
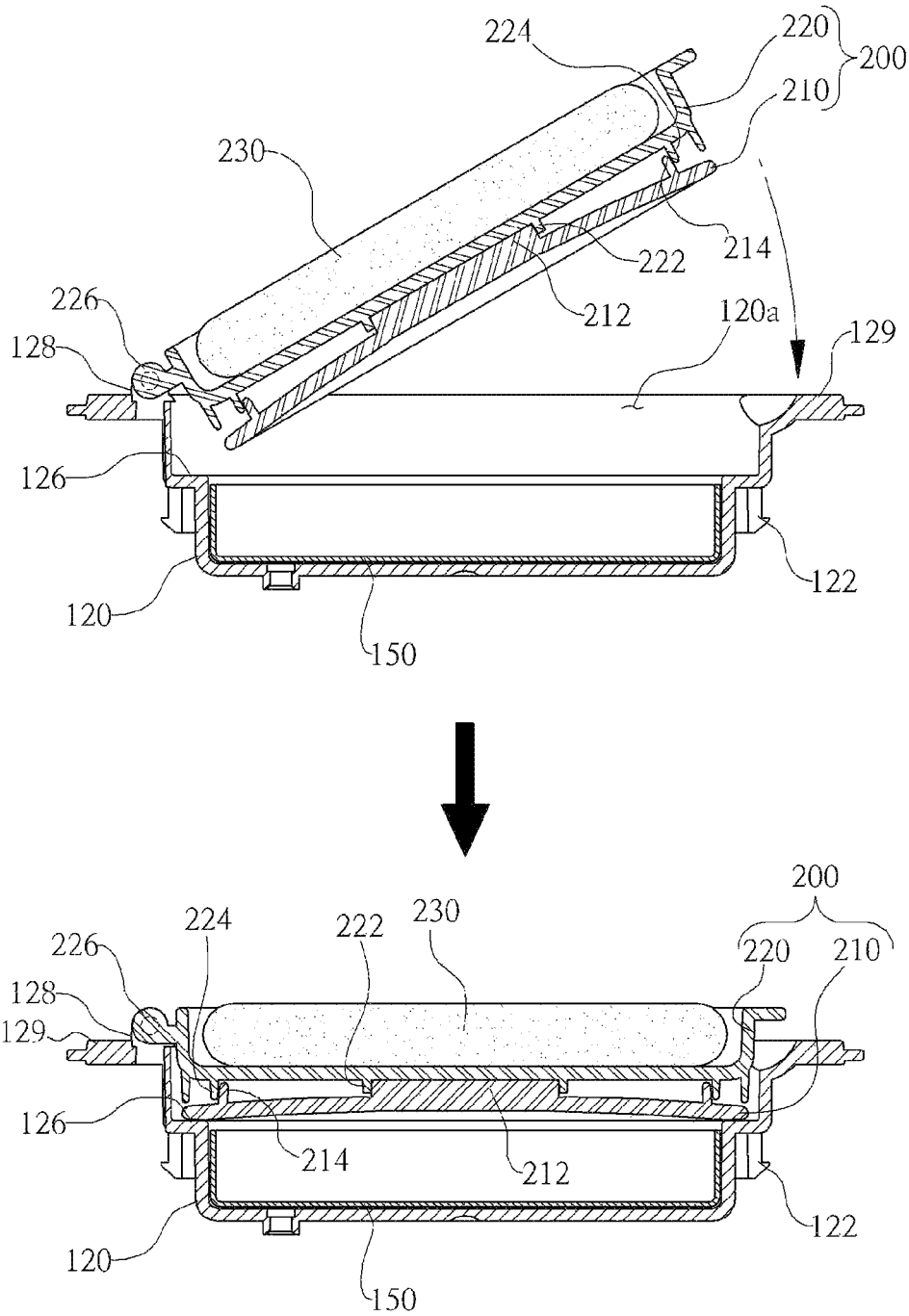
FIG. 5 illustrates the operation of coupling a suction cover unit to a second main body of the cosmetic case according to the embodiment of the present invention.

FIG. 5 is a view showing the operation of coupling the suction cover unit 200 to the second main body 120 of the cosmetic case according to the embodiment of the present invention.

Referring to FIG. 5, the suction cover unit 200 includes the puff receiving member 220 and the suction member 210. The puff receiving member 220 is configured such that it can be received in the second main body 120. A second connection part 222 is provided under the puff receiving member 220 so that the puff receiving member 220 is coupled to the suction member 210 by the second connection part 222. The puff receiving member 220 functions to receive the puff 230 or different kinds of make-up tools therein. The puff 230 is a tool with which the user can apply, for example, cosmetic powder or the like to his/her skin. A hinge coupling part 226 is provided on a circumferential side surface of the puff receiving member 220. The hinge coupling part 226 is hinged to a coupling guide part 128 which is provided on an upper portion of the second main body 120, so that the puff receiving member 220 can be rotated with respect to the second main body 120. Meanwhile, the puff receiving member 220 may be coupled to the upper portion of the second main body 120 by a simple fitting method.

The suction member 210 has a circular shape. A first connection part 212 is provided on a central portion of the upper surface of the suction member 210 so that the suction member 210 can be coupled to the second connection part 222. The perimeter of the suction member 210 is attached to the upper surface of the support surface 126 of the second main body 120 by vacuum suction force. To easily and reliably attach the suction member 210 to the upper surface of the support surface 126 using suction force, the suction member 210 is configured such that the lower surface thereof is gradually curved upwards from the perimeter to the central portion, and the suction member 210 is preferably made of soft material such as rubber that has high elasticity and can provide high suction force. Furthermore, to dispose the perimeter of the suction member 210 at a position lower than the central portion thereof, a first support part 214 protrudes from the perimeter of the upper surface of the suction member 210 towards the puff receiving member 220, and a second support part 224 protrudes from the perimeter of the puff receiving member 220 in such a way that the second support part 224 is disposed on the side surface of the first support part 214. Here, the distances that the first and second support parts 214 and 224 protrude are longer than those of the first and second coupling parts 212 and 222 so that the perimeter of the lower surface of the suction member 210 is disposed below the central portion thereof.

When the puff receiving member 220 covers the second opening 120*a* of the second main body 120, the suction member 210 coupled to the puff receiving member 220 is reliably attached to the upper surface of the support surface 126 of the second main body 120 by vacuum suction force. Thereby, the interior of the second main body 120 can be tightly sealed. As such, because the interior of the second main body 120 is tightly sealed by the suction member 210, in other words, because there is no gap between the second main body 120 and the suction member 210, cosmetics contained in the second main body 120 can be prevented from being contaminated during a process of distribution, and the weight of cosmetics can be maintained.

Meanwhile, once the suction member 210 is attached to the support surface 126 by means of suction force, it is difficult to detach the suction member 210 therefrom if there is no special means. Given this, the present invention is provided with the suction force removal unit 300 to easily remove suction force that has been applied to the suction member 210. This will be explained later herein with respect to the following attached drawings.

Figure 6:
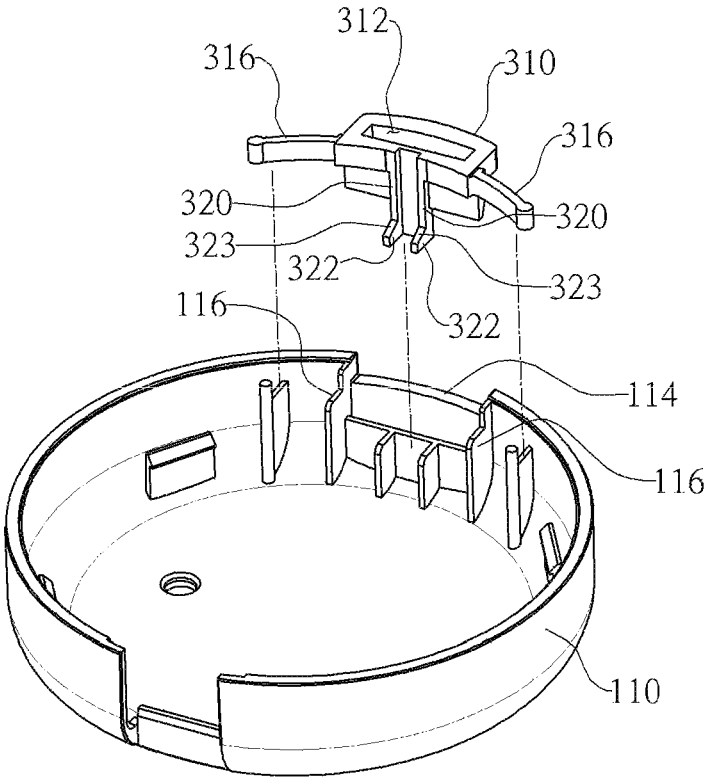
FIG. 6 is a view illustrating the coupling of a button member of a suction force removal unit to a first main body of the cosmetic case according to the embodiment of the present invention.
Figure 7:
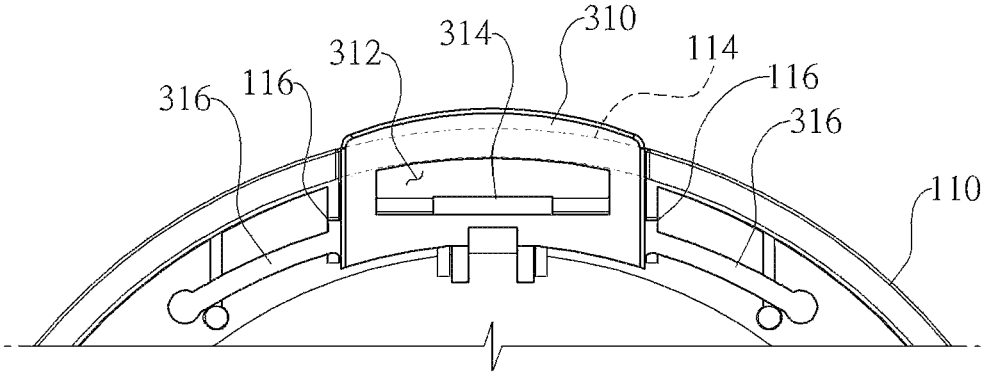
FIG. 7 is a view illustrating the button member disposed between the first main body and a second main body of the suction force removal unit of the cosmetic case according to the embodiment of the present invention.

FIG. 6 is a view illustrating the coupling of the button member 310 of the suction force removal unit 300 to the first main body 110 of the cosmetic case according to the embodiment of the present invention. FIG. 7 is a view illustrating the button member 310 disposed between the first main body 110 and a second main body 120 of the suction force removal unit 300 of the cosmetic case according to the embodiment of the present invention.

Referring to FIGS. 6 and 7, the side space 130 is defined between the circumferential side surfaces of the first and second main bodies 110 and 120. A button exposure part 114 is formed in an upper portion of the circumferential side surface of the first main body 110 so that the button member 310 is exposed to the outside through the button exposure part 114. A button guide part 116 which extends downwards from the button exposure part 114 is provided on the inner surface of the circumferential side surface of the first main body 110 so that the button member 310 which will be explained later herein is guided by the button guide part 116.

The suction force removal unit 300 includes the button member 310 and the suction force removal member 330. The button member 310 is moved forwards and backwards in the side space 130 by the pressing force transmitted from the user. An outer part of the button member 310 is exposed to the outside through the button guide part 116 of the first main body 110. An inner part of the button member 310 is disposed in the side space 130 between the first main body 110 and the second main body 120. A pair of extensions 320 extends downwards from the inner part of the button member 310 to a position below the support surface 126. An inclined part 322 protrudes from a lower end of each extension 320 towards the circumferential side surface of the second main body 120. The inclined part 322 has an inclined pressing surface 323 which is inclined downwardly towards the circumferential side surface of the second main body 120. The suction force removal member 330 is disposed on the inclined pressing surfaces 323. The suction force removal member 330 will be explained in detail later herein.

Elastic protrusions 316 are respectively provided on opposite sides of the inner part of the button member 310. The elastic protrusions 316 extend from the inner part of the button member 310 along the inner circumferential surface of the first main body 110. In addition, the elastic protrusions 316 are supported on the inner circumferential surface of the first main body 110. When the outer part of the button member 310 is pressed by external pressure towards the second main body 120, that is, inwards, the button member 310 is biased outwards by the elastic force of the elastic protrusions 316. When the outer part of the button member 310 is released, the button member 310 is moved outwards and returned to its original position by the elastic force of the elastic protrusions 316. The width of the side space 130 in which the button member 310 is disposed corresponds to the distance that the button member 310 can move inwards and outwards. Here, the ends of the elastic protrusions 316 are fixed at predetermined positions in the side space 130 so that, when the button member 310 that has been moved inwards is released, the button member 310 can be reliably moved outwards by the elastic force of the elastic protrusions 316. Thus, the button member 310 that has been moved inwards can reliably return to its original position without using a separate spring.

An insert hole 312 is formed in an upper surface of the inner part of the button member 310. A locking hook 314 is provided on the inner surface of the insert hole 312, and the cover 400 is releasably locked to the locking hook 314. This locking structure will be explained later herein with reference to FIG. 11.

Figure 8:
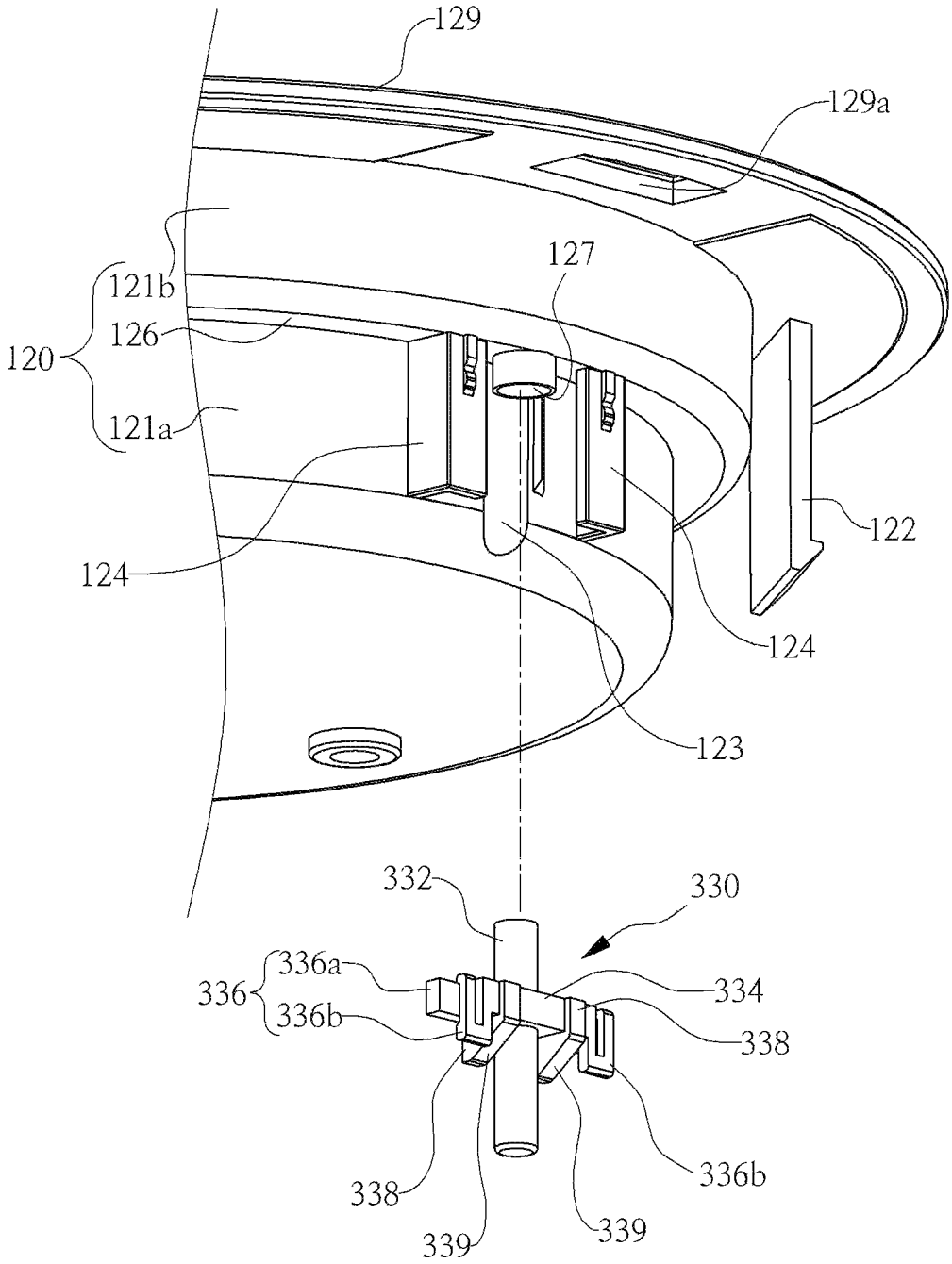
FIG. 8 is a view showing coupling of a suction force removal member of the suction force removal unit to the second main body of the cosmetic case according to the embodiment of the present invention.
Figure 9A:
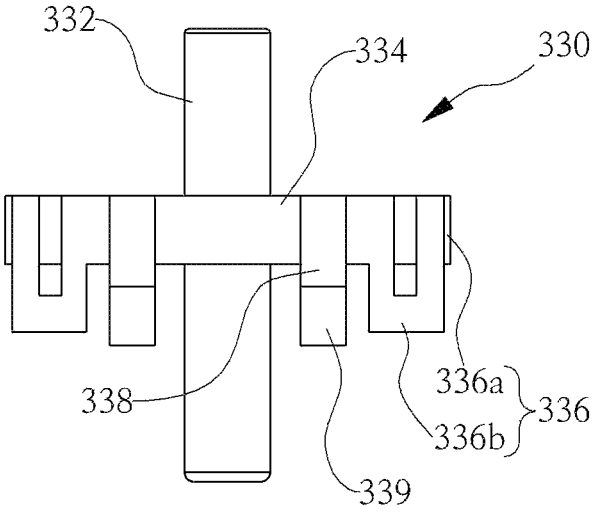
FIG. 9*a* and FIG. 9*b* illustrate the suction force removal member of the suction force removal unit of the cosmetic case according to the embodiment of the present invention.
Figure 9B:
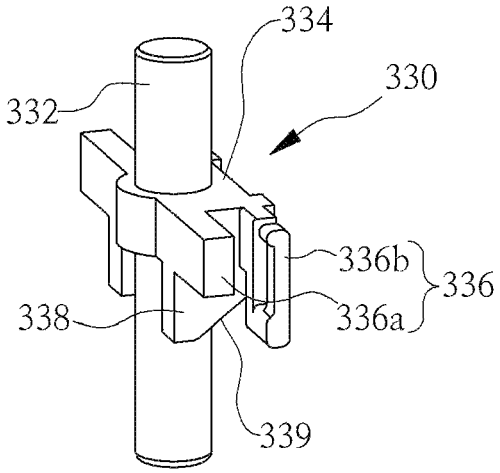
Figure 10:
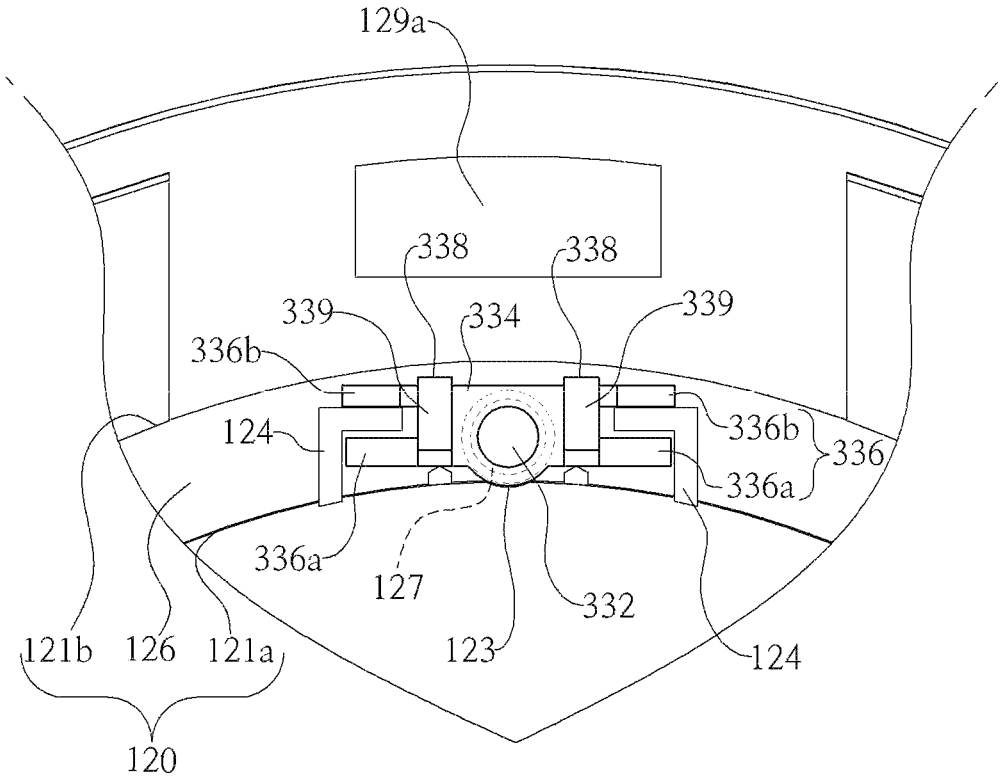
FIG. 10 is a view illustrating the coupling structure of the button member and the suction force removal member of the cosmetic case according to the embodiment of the present invention.

FIG. 8 is a view showing coupling of the suction force removal member 330 of the suction force removal unit 300 to the second main body 120 of the cosmetic case according to the embodiment of the present invention. FIG. 9*a* and FIG. 9*b* illustrate the suction force removal member 330 of the suction force removal unit 300 of the cosmetic case according to the embodiment of the present invention. FIG. 10 is a view illustrating the coupling structure of the button member 310 and the suction force removal member 330 of the cosmetic case according to the embodiment of the present invention.

Referring to FIGS. 8 through 10, when the button member 310 is inserted between the first main body 110 and the second main body 120, the suction force removal member 330 is disposed at a position of the second main body 120 that faces the button member 310, in more detail, on the outer circumferential surface of the lower cylindrical side surface 121*a* of the second main body 120. Guiding up-and-down movement of the suction force removal member 330, guide protrusions 124 are provided on the outer circumferential surface of the lower cylindrical side surface 121*a* of the second main body 120 at opposite sides of the suction force removal member 330.

The suction force removal member 330 is disposed inside the button member 310 and moved upwards and downwards. The suction force removal member 330 includes a guide protrusion 332 and a support part 334. The guide protrusion 332 is disposed in the side space 130 between the first main body 110 and the second main body 120, in detail, on the outer circumferential surface of the lower cylindrical side surface 121*a* of the second main body 120. The guide protrusion 332 extends a predetermined length, and an upper end thereof passes through a through hole 127 formed in the support surface 126 and is located facing the suction member 210 provided on the upper surface of the support surface 126. A lower end of the guide protrusion 332 is located between the extensions 320 of the button member 310. A guide groove 123 is formed in the outer circumferential surface of the lower cylindrical side surface 121*a* of the second main body 120 at a position corresponding to the guide protrusion 332 so that the guide protrusion 332 can be smoothly moved upwards and downwards. An upper end of the guide groove 123 is connected to the through hole 127.

The support part 334 connects the guide protrusion 332 to movement guides 338 which will be explained later herein. The support part 334 extends perpendicular to the guide protrusion 332 in opposite directions from the medial portion of the guide protrusion 332. Vertical guide parts 336 are provided on respective opposite ends of the support part 334 and guided upwards and downwards by the guide protrusions 124 of the second main body 120. Each vertical guide part 336 includes a first guide 336*a* and a second guide 336*b*. The first guide 336*a* and the second guide 336*b* protrude from each of the opposite ends of the support part 334 at positions spaced apart from each other. The corresponding guide protrusion 124 of the second main body 120 is inserted into a space between the first guide 336*a* and the second guide 336*b*, whereby the vertical guide part 336 can be moved upwards and downwards along the guide protrusions 124.

The movement guides 338 extend downwards between the guide protrusion 332 and the respective opposite ends of the support part 334. Lower ends of the movement guides 338 are disposed to be brought into contact with the inclined pressing surfaces 323 of the button member 310. Coming into close contact with the corresponding inclined pressing surface 323, an inclined guide surface 339 is formed in a lower end of each movement guide 338. When the inclined pressing surfaces 323 of the button member 310 are moved inwards by movement of the button member 310, the inclined guide surfaces 339 move upwards because of variation in the height of the inclined pressing surfaces 323, whereby the guide protrusion 332 is moved upwards. Then, the upper end of the guide protrusion 332 pushes the suction member 210 upwards, thus removing the suction force of the suction member 210. This operation will be explained in detail with reference to the following drawings.

Figure 11:
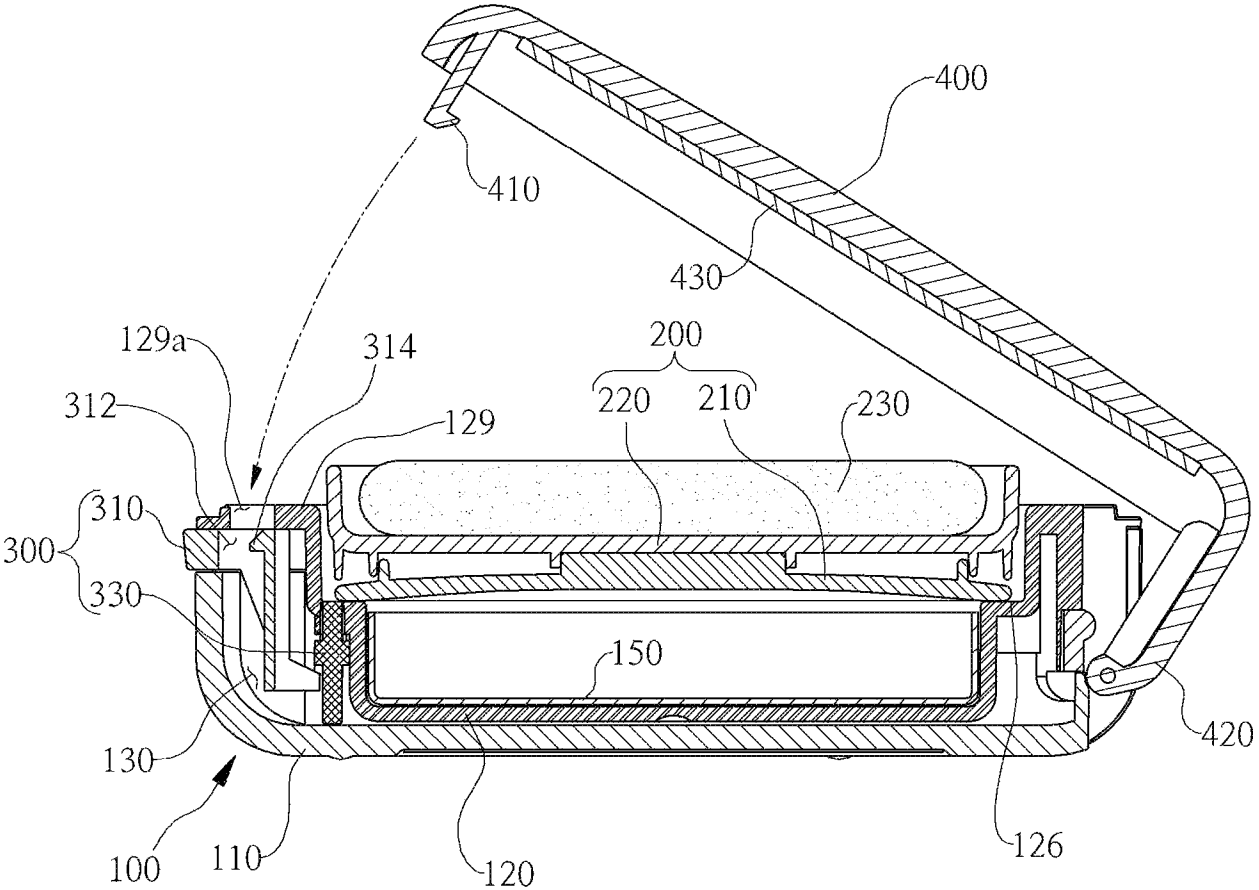
FIG. 11 is a view illustrating the operation of locking a cover to the button member of the cosmetic case according to the embodiment of the present invention.

FIG. 11 is a view illustrating the operation of locking the cover 400 to the button member 310 of the cosmetic case according to the embodiment of the present invention.

Referring to FIG. 11, the first side portion of the cover 400 is hinged to the first main body 110 so as to be rotatable relative to the first main body 110. When the cover 400 closes the first main body 110 and the second main body 120 of the main body 100, a locking protrusion 410 provided on the second side portion of the cover 400 is locked to the locking hook 314 of the button member 310. For this, a locking guide hole 129*a* is formed in the rim part 129 of the second main body 120 at a position corresponding to the button member 310. Facing the locking guide hole 129*a*, the insert hole 312 is formed in the upper surface of the inner part of the button member 310 that is disposed in the side space 130. The locking hook 314 is provided on the inner surface of the insert hole 312 towards the second main body 120. When the cover 400 closes the main body 100, the locking protrusion 410 of the cover 400 is inserted into both the locking guide hole 129*a* of the second main body 120 and the insert hole 312 of the button member 310 and then hooked to the locking hook 314 of the button member 310.

In this state, when the user presses the outer part of the button member 310, the inner part of the button member 310 is moved inwards, and the locking hook 314 of the button member 310 is also moved inwards, that is, towards the second main body 120. Then, the locking protrusion 410 of the cover 400 that has been locked to the locking hook 314 is removed from the locking hook 314 is released from the locking hook 314, thus enabling the cover 400 to open. Simultaneously, as the inclined pressing surfaces 323 moves inwards along with the button member 310, the guide protrusion 332 of the suction force removal member 330 moves upwards, thus lifting the suction member 210. As a result, the suction force of the suction member 210 is removed. This operation will be explained in detail with reference to the following attached drawing.

In this embodiment of the present invention, although the cover 400 has been illustrated as being hinged to the main body 100 and releasably locked to the locking hook 314 of the button member 310, the present invention is not limited to this structure. For example, the present invention may be configured in such a way that a first thread (not shown) is formed on the outer circumferential surface of the first main body 110, and a second thread (not shown) is formed in the cover 400 so that the cover 400 is threaded over the first main body 110.

Figure 12:
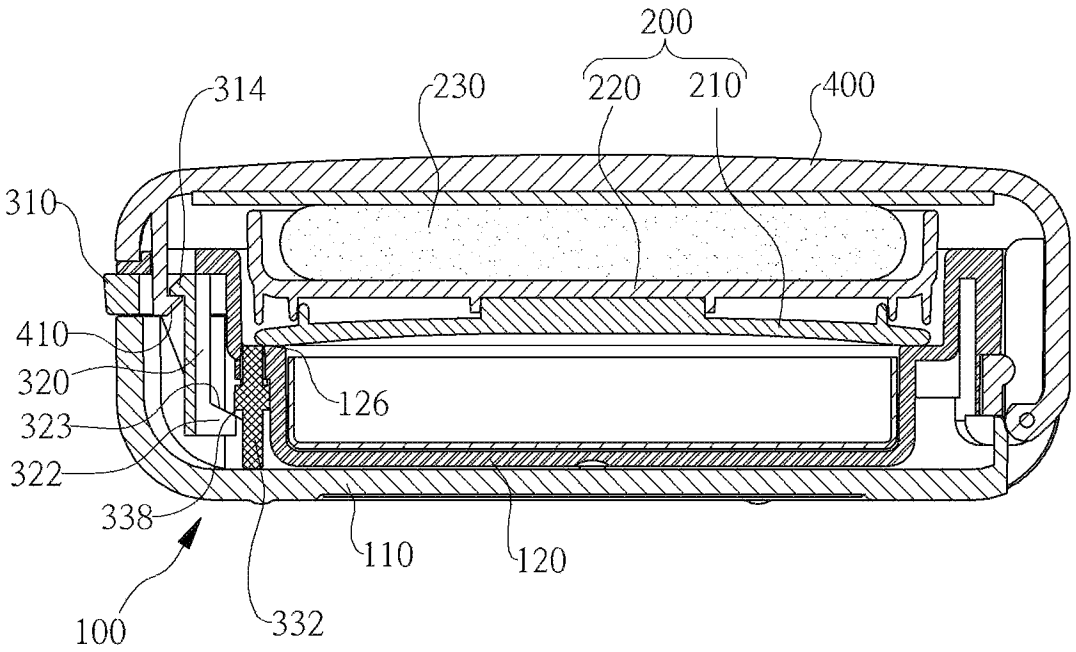
FIGS. 12 and 13 are views illustrating the operation of the suction force removal member to remove the suction force of a suction member of the cosmetic case according to the embodiment of the present invention.
Figure 13:
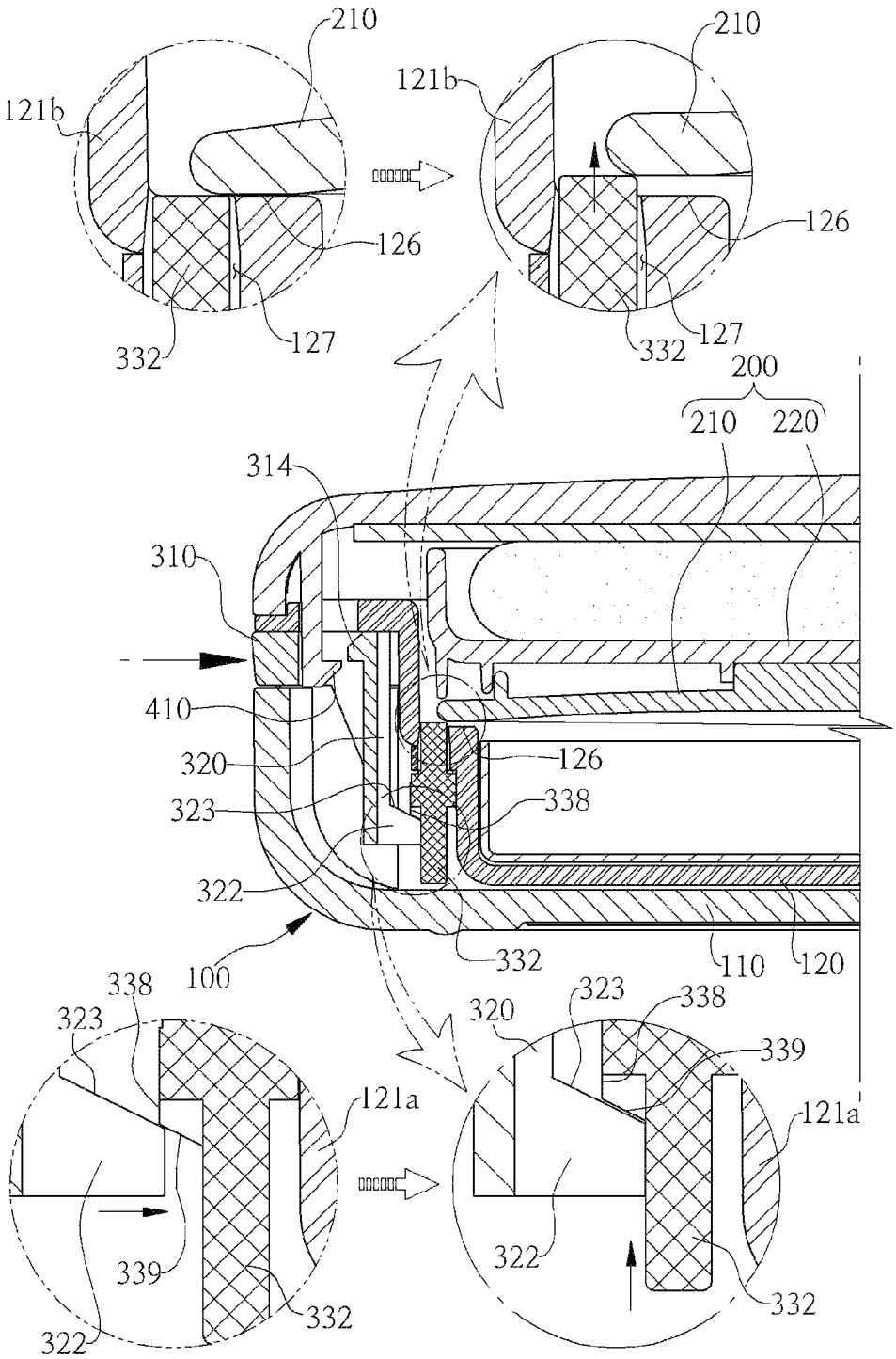

FIGS. 12 and 13 are views illustrating the operation of the suction force removal member 330 to remove the suction force of the suction member 210 of the cosmetic case according to the embodiment of the present invention.

Referring to FIG. 12, when the puff receiving member 220 of the suction cover unit 200 is disposed to cover the second main body 120, the suction member 210 of the suction cover unit 200 is reliably attached to the upper surface of the support surface 126 by vacuum suction force. Then, the interior of the second main body 120 is airtightly sealed. When the cover 400 closes the first main body 110, the locking protrusion 410 of the cover 400 is locked to the locking hook 314 of the button member 310 so that the cover 400 can be prevented from undesirably opening.

Referring FIG. 13, when the user presses the outer part of the button member 310 that is exposed to the outside, the inner part of the button member 310 is moved inwards. Then, the locking hook 314 of the button member 310 is also moved inwards, whereby the locking protrusion 410 of the cover 400 that has been locked to the locking hook 314 is released from the locking hook 314. As a result, the cover 400 opens.

Simultaneously, as the button member 310 moves inwards, the inclined pressing surface 323 that is integrally provided with the button member 310 is also moved inwards. Then, because the inclined pressing surface 323 that comes into contact with the inclined guide surface 339 of the suction force removal member 330 has an inclined structure, the inclined guide surface 339 of the suction force removal member 330 moves upwards along the inclined pressing surface 323. Thus, the guide protrusion 332 that is integrally provided with the inclined guide surface 339 of the suction force removal member 330 is also moved upwards, whereby the upper end of the guide protrusion 332 lifts the suction member 210 that has been attached to the upper surface of the support surface 126 of the second main body 120. Then, space is formed between the support surface 126 and the suction member 210, and air is drawn into the space so that the suction force of the suction member 210 is removed.

As such, when the user presses the button member 310, the cover 400 opens and, simultaneously, the suction force of the suction member 210 is removed, thus making it easy for the user to open the cover 400 and the suction cover unit 200.

As described above, in the present invention, a suction member can be reliably attached to the main body by means of suction force so that a gap is prevented from being formed therebetween. Accordingly, cosmetics contained in the main body can be prevented from being contaminated during a process of distribution, and the weight of cosmetics can be maintained as it is.

Furthermore, when the user presses a button member, a cover opens and, simultaneously, the suction force of the suction member is removed, thus allowing the user to easily open the cover and suction cover unit.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A cosmetic case having a sealing function, comprising:

a main body defining a receiving space therein and having an opening formed above the receiving space, with a support surface provided on an inner circumferential surface of the receiving space, the support surface being oriented facing the opening;

a suction cover unit inserted into the receiving space, the suction cover unit comprising a suction member closing the opening in such a way that a perimeter of an inner surface of the suction member is attached to an upper surface of the support surface by suction force; and a suction force removal unit comprising: a button member having a first side portion disposed to be exposed to an outside from an outer surface of a circumferential side surface of the main body, and a second side portion disposed in a space defined inside the circumferential side surface of the main body; and a suction force removal member disposed inside the circumferential side surface of the main body at a position facing the second side portion of the button member, the suction force removal member being moved upwards by a pushing force of the button member so that an upper end of the suction force removal member passes through the support surface and moves the suction member upwards.

2. The cosmetic case as set forth in claim 1, wherein the second side portion of the button member is disposed below the support surface and comprises an inclined part provided around an inner surface of the circumferential side surface of the main body, the inclined part having an inclined pressing surface inclined downwardly towards a central portion of the main body, and the suction force removal member comprises: a guide protrusion having an upper end passing through the support surface; and a movement guide protruding from the guide protrusion towards the inclined pressing surface, wherein when the inclined pressing surface is moved towards the central portion of the main body by the pushing force of the button member, the movement guide that comes into contact with the inclined pressing surface moves upwards along the inclined pressing surface, whereby the upper end of the guide protrusion pushes the suction member upwards.

3. The cosmetic case as set forth in claim 1, further comprising a cover covering the opening, wherein an insert hole is formed in the second side portion of the button member, the insert hole being open towards an upper portion of the main body, and a locking hook is provided in the insert hole and oriented towards the inner surface of the circumferential side surface of the main body, a first side portion of the cover is rotatably coupled to a portion of the main body, and a locking protrusion is provided on a second side portion of the cover, the locking protrusion being inserted into the insert hole through the upper portion of the main body and locked to the locking hook, and when the locking hook is moved by the pushing force of the button member, the locking protrusion is released from the locking hook.

4. The cosmetic case as set forth in claim 1, wherein the main body has a double structure comprising a first main body and a second main body disposed in the first main body, and the suction force removal unit is provided in space formed between a circumferential side surface of the first main body and a circumferential side surface of the second main body, and a guide unit is provided on an inner surface of the circumferential side surface of the first main body or an outer surface of the circumferential side surface of the second main body, the guide unit guiding movement of the button member or the suction force removal member.

5. The cosmetic case as set forth in claim 4, wherein an elastic protrusion is provided on the second side portion of the button member, the elastic protrusion extending along the inner surface of the circumferential side surface of the first main body, wherein when the button member is pushed towards the second main body, the button member is elastically biased by elastic force of the elastic protrusion in a reverse direction.

6. The cosmetic case as set forth in claim 1, wherein the suction cover unit further comprises a puff receiving member provided on an upper surface of the suction member.

7. The cosmetic case as set forth in claim 1, wherein a side portion of the suction cover unit is rotatably coupled to the main body.

8. The cosmetic case as set forth in claim 1, wherein the suction member is made of soft material having elasticity and capable of providing suction force and is configured such that a lower surface thereof is gradually curved upwards from a perimeter thereof to a central portion.

9. The cosmetic case as set forth in claim 1, further comprising a tray provided in the receiving space of the main body to receive contents therein, the tray being configured such that an upper end thereof is disposed below the support surface.

* * * * *